US009481947B2

(12) United States Patent
Hartmeier et al.

(10) Patent No.: US 9,481,947 B2
(45) Date of Patent: Nov. 1, 2016

(54) METHOD AND DEVICE FOR MONITORING CONTACTS OF A ROTATING COMPONENT OF A TEXTILE MACHINE

(71) Applicant: Maschinenfabrik Rieter AG, Winterthur (CH)

(72) Inventors: Werner Hartmeier, Winterthur (CH); Xaver Baumann, Müllheim (CH)

(73) Assignee: Maschinenfabrik Rieter AG, Winterthur (CH)

( * ) Notice: Subject to any disclaimer, the term of this patent is extended or adjusted under 35 U.S.C. 154(b) by 416 days.

(21) Appl. No.: 14/105,287

(22) Filed: Dec. 13, 2013

(65) Prior Publication Data

US 2014/0167730 A1 Jun. 19, 2014

(30) Foreign Application Priority Data

Dec. 14, 2012 (EP) ..... 12008343

(51) Int. Cl.
*D01G 15/28* (2006.01)
*G01M 13/00* (2006.01)

(52) U.S. Cl.
CPC ..... *D01G 15/28* (2013.01); *G01M 13/00* (2013.01)

(58) Field of Classification Search
CPC ..... D01G 15/28
See application file for complete search history.

(56) References Cited

U.S. PATENT DOCUMENTS 3,508,145 A * 4/1970 Bilbrough ..... G01N 22/04 324/632
5,606,509 A 2/1997 Denz et al.
5,713,106 A * 2/1998 Dammig ..... D01H 5/38 19/23
7,609,021 B2 10/2009 Bay et al.
7,874,046 B2 * 1/2011 Leinders ..... D01G 15/28 19/240
2002/0050027 A1 * 5/2002 Leder ..... D01G 15/28 19/114
2007/0163086 A1 * 7/2007 Leinders ..... D01G 15/28 19/98
2007/0266528 A1 * 11/2007 Farber ..... D01G 15/28 19/98
2008/0072401 A1 * 3/2008 Tobben ..... D01G 15/08 19/98

FOREIGN PATENT DOCUMENTS

DE 31 41 537 A1 5/1983
DE 3937912 A1 * 5/1991 ..... G01B 7/14
GB 2063477 A * 6/1981 ..... F01D 11/08
WO WO 2006/119655 A1 11/2006
WO WO 2006/119658 A1 11/2006

OTHER PUBLICATIONS

EP Search Report, May 27, 2013.

* cited by examiner

*Primary Examiner* — Shaun R Hurley
(74) *Attorney, Agent, or Firm* — Dority & Manning, P.A.

(57) ABSTRACT

A method for monitoring contact of a rotating component of a textile machine, in particular of a clothing roller of a card, for example a card cylinder, with a further component of the textile machine. The two components are connected to an electrical power source, but are normally electrically isolated from each other, and only in the case of a contact between the two components, a short-circuit is generated, which is detected by the monitoring device. The duration of individual short-circuits per time unit (T) is detected and summed up so as to form a total duration (t) of all short-circuits per time unit (T).

15 Claims, 4 Drawing Sheets

METHOD AND DEVICE FOR MONITORING CONTACTS OF A ROTATING COMPONENT OF A TEXTILE MACHINE

FIELD OF THE INVENTION

The present invention relates to a method (and corresponding textile machine) for monitoring contact of a rotating component of a textile machine, in particular of a clothing roller of a card, for example of a card cylinder, with a further component of the textile machine, wherein the two components are connected to an electric power source, but usually are electrically isolated from each other. Only in the event of a contact between the two components, a short-circuit is generated that is detected by a monitoring device.

BACKGROUND

In DE 10 2006 002 812 A1, a generic device and a corresponding method are described. In a spinning preparation machine, in particular a card, carding machine, or the like, in which a clothed fast-rotating roller is arranged opposite to at least one clothed and/or non-clothed component and the spacing between the opposing components is changeable, it is provided for monitoring and/or adjusting of spacings at the components that the components are electrically insulated with respect to each other. As respective contact elements, these components are connected to an electrical circuit in which a measuring element for contact detection is integrated. The clothed fast-rotating roller is, for example, a card cylinder, wherein the opposing clothed and/or non-clothed component are/is, for example, a doffer roller, a flat or a casing segment that has a guiding surface. Between the roller and the component arranged spaced apart therefrom, there is the so-called carding gap. This carding gap is very narrow and can change during the operation due to the components heating up. This can result in contacts between the fast-rotating roller and the opposing component. Such contacts are to be avoided whenever possible.

Accordingly, DE 10 2006 002 812 A1 proposes to avoid undesirable frequent contact between the components and therefore to avoid damage to the clothing by determining the number of contacts, as a result of which an indication or reaction in the case of only one of these contacts or only a few contacts is avoided. In particular, an undesirable shutdown of the machine is avoided in this manner. In order to achieve this, an evaluation of the number of contacts of a certain contact duration, e.g., a contact duration of 0.1 ms, 1 ms or 2 ms is filtered. For this purpose, a counting device is provided which determines the number of contacts per time unit between a card clothing and a clothing strip. This number or amount of contacts is used for further evaluation and for the reaction resulting therefrom, for example, for stopping the card or for continued operation of the card.

A disadvantage of this solution is that each individual tooth of the clothing generates an individual contact with the opposing component and therefore increases the number of contacts. The technical implementation of this proposal is very complicated. In particular, for a component that is arranged opposite to the clothed card cylinder and is also provided with a clothing, it is necessary to monitor each individual clothing needle in terms of its potential so as to be able to detect the number of contacts. Apart from that, determining the number or amount of contacts would not be possible since a short contact with this clothing-covered component would already indicate a single contact in the same manner as it would indicate continuous contacting of both components across a plurality of clothing tips. This very inaccurate or else very complicated determination of the number of contacts is hardly implementable in practice.

SUMMARY OF THE INVENTION

It is therefore an object of the present invention to enable simple and particularly effective monitoring of contacts between components of a textile machine that have approached each other, so as to be able to draw corresponding conclusions on the further operation of the textile machine. Additional objects and advantages of the invention will be set forth in part in the following description, or may be obvious from the description, or may be learned through practice of the invention.

The method according to the invention serves for monitoring contacts of the rotating component of a textile machine, in particular of a clothing roller of a card, for example of a card cylinder, with a further component of the textile machine. The two components are connected to an electrical power source. Normally, i.e., when both components are not in contact with each other, they are electrically isolated from each other. Only in the case of contact between the two components, a short-circuit is generated that is detected by a monitoring device.

According to the invention, not the number of individual short-circuits is detected, but the duration of individual short-circuits per time unit is detected and summed up to form a total duration of all short-circuits per time unit. This has the substantial advantage that a kind of quality assessment can take place with regard to an actual risk of damage to the textile machine due to excessive contacts. In particular, if only individual short contacts and only a few contacts take place between opposing components, normally, no danger to the machine is to be expected. Such short contacts can occur if fiber contaminants, for example, small metal particles temporarily adhere between the two opposing components and subsequently disengage again and are conveyed out of the machine. Also, if individual teeth of the clothing or clothings generate a short-time contact, they normally grind each other down within a very short time so that in the future no further contact is generated therefrom. However, if, for example, excessive heating of the card cylinder generates a long lasting contact between the two opposing components, this can be a massive threat to the machine. For example, during a long lasting time period of short-circuits it can be derived therefrom that there is a more severe danger for the machine than during only short-term contacts or short-circuits per time unit.

Also, the particular advantage of the invention is that even in the case of clothing teeth that oppose each other, the teeth do not have to be detected individually in order to determine the number of contacts; rather, each of the individual components can be provided with only one opposite pole. This results in a short-circuit even if there is a multiplicity of contact points in this component. Thus, the present invention can be used in a particularly advantageous manner, for example, for a card cylinder and the clothed flat bars or clothed rollers opposite to the card cylinder.

The present invention can also be used if the clothed rotating card cylinder faces a flat component, for example, a shielding or guiding device. In all these cases, the contact duration is to be determined, independent of the number of contacts, so as to enable therefrom particularly effective monitoring with regard to a potential danger to the textile machine.

In an advantageous embodiment of the invention, the duration of one revolution of the rotating component or a fraction or a multiple of the duration of this revolution is used as the time unit which is used for evaluating the duration of individual short-circuits or the total duration of all short-circuits. In this manner it can be determined that there is a certain contact duration per revolution of, for example, the card cylinder. If this contact duration exceeds a predetermined admissible contact duration, adequate measures can be initiated such as, for example, shutting down the textile machine or adjusting the spacing between the components opposing each other.

It is advantageous if, from the total duration of the short-circuits per time unit and the time unit itself, a quotient is formed. This quotient, which implies that in the case of a high value, long lasting contacting between the components took place and that in the case of a low value, this duration of contacting was rather short, can be used for the monitoring device or a correspondingly allocated evaluation unit as a measure for measures to be taken.

The quotient from the total duration of the short circuits per time unit and the time unit itself is advantageously to be used a measure for the quality of the setting of the textile machine. For example, it can well be acceptable that a low value of this quotient indicates a particularly good setting of the textile machine, whereas if the quotient is zero, the spacing between the components opposing each other is possibly too large. However, if the value of this quotient is very high, this indicates that the gap between the components opposing each other is too small and that contacting takes too long, resulting in danger to the machine. An acceptable value for the quality of the setting of the textile machine and the corresponding quotient may result from the experience of the operator of the textile machine or from the type of the components that face each other and are monitored. Thus, for example, a somewhat higher quotient can be accepted for clothing wires which are configured elastically, whereas for stationary guide walls or fixed all-steel clothings, the value has to be lower so as to rule out damage.

When exceeding a predetermined total duration of the short-circuits of a time unit and/or the value of the quotient from the total duration and the time unit itself, an advantageous measure can be that the rotating component and/or the further component are/is machined, in particular by grinding. By grinding, very fine material removal can be achieved and consequently, very fine adjustment of the components opposing each other can be carried out.

An advantageous other or additional measure when exceeding the duration of individual short circuits and/or the total duration of all short-circuits per time unit and/or the quotient can be that the spacing between the rotating and the further component is increased. However, it has always to be ensured that this does not seriously jeopardize the quality of the fiber material to be processed since normally a particularly narrow carding gap produces a better quality than a larger carding gap.

Preferably, the duration of individual short-circuits per time unit and/or the quotient from the total duration of all short-circuits per time unit and the time unit itself is displayed on a display device. In this manner, the operator of the textile machine is able to initiate suitable measures for adjusting the machine if the corresponding value is unsatisfactory.

In a particularly advantageous configuration of the invention, the rotating and/or the further component are/is divided along an axis of the rotating component into axial sections that are electrically isolated from each other. In particular, in the case of stationary components, it is possible in a very simple manner to isolate them from each other in sections transverse to the rotational direction of the rotating component. These sections, that are isolated from each other, can be analyzed independently of each other with regard to their contact duration. In this manner, measures to be taken can be localized more easily. Thus, for example, it is possible to detect that the sag of the stationary component is too great if the contact duration in the middle of the stationary component is longer than in the lateral regions. As a possible measure in this example, adjusting the sag of the component or machining the component may be carried out only in the middle region.

A textile machine according to the invention is suitable for carrying out the above-mentioned method. The textile machine comprises in particular a clothing roller of a card, for example, a card cylinder, which is arranged spaced apart from a further component of the textile machine by a small gap, for example, a carding gap. The two components are connected to an electrical power source. As long as they are spaced apart from each other, the two components are electrically isolated from each other. A short-circuit, that can be detected by means of a monitoring device, occurs only in the case of contact between the two components.

The monitoring device, for example, is integrated in the circuit which, in the case of a short-circuit or contact, connects the two components to each other and indicates that there is current flow or a short-circuit. The monitoring device is designed for detecting the duration of individual short-circuits and to sum them up so as to form a total duration of all short-circuits per time unit. Accordingly, the monitoring device is able to add up the duration of the individual short-circuits per time unit and therefore to determine a total value of the short-circuits or contacts within this time unit. This total duration of all short-circuits is independent of the number of contacts, i.e., how often contacts per time unit have taken place. The only decisive factor is how long in total a contact per this time unit has taken place or, in other words, how long no contact per time unit has taken place. Thus, in the first extreme case, it can occur that this total duration has the value zero, i.e., the gap between the rotating component and the other component is large enough so that they do not touch each other. In the other case, if the total duration of the contact is equal to the time unit itself, a continuous contact or a continuous short-circuit takes place. This indicates that a contact takes place constantly somewhere between the components that face each other. The cause of this, compared to the prior art, can either be a very high number of individual contacts or only a single contact which is simply continuously present during the entire time unit.

The number of individual contacts, which is regarded essential in the prior art, is not relevant for the present invention. Decisive here is only how long in total a contacting takes place, irrespective of whether this contact duration results from a high number of individual contacts or only from a single contact. If the duration of a short-circuit or contact(s) is too long, according to the present invention, a suitable measure for improving the quality of the mode of operation of the textile machine is initiated. Thus, this is a substantial difference between the present invention and the prior art.

In an advantageous textile machine, the further component is a stationary component, a rotating component or, alternatively, a component that moves along the surface of the rotating first component. Thus, the further component can be, for example, a guide plate as a stationary component, or it can be a rotating clothed doffer roller. Likewise, it is possible that the further component is a flat bar that is guided along the surface of the card cylinder and moves accordingly. In principle, any component that is located opposite to the rotating component, in particular to the card cylinder, and that is to be arranged at a close spacing from the rotating component, can be this further component. Suitable spacing between the two components can be determined by the monitoring device.

Preferably, a rotational-speed sensor, e.g., a pulse generator or angular position sensor, is associated with the rotating component. This rotational-speed sensor is able to provide a time unit which relates to the revolution of the rotating component, in particular of the card cylinder. The suitable time unit in this case is, for example, one revolution of the card cylinder so that, for example, unevenness on the card cylinder can be detected in a very simple manner. Alternatively, a fraction of this revolution or a multiple of this revolution can also be used as a suitable time unit.

In a further advantageous embodiment, a device for detecting the revolutions or the position of the rotating component by means of pattern recognition can also be associated with the textile machine. Here, the pattern of the contacts or short-circuits, which do not change or change only insignificantly from one revolution to the next one, is detected and evaluated for the recognition of individual revolutions.

In a further embodiment of the present invention, it is advantageously provided that the textile machine comprises a rotating component and/or the further component which, along an axis of the rotating component, i.e., transverse to the circumferential direction of the rotating component, are/is divided into a plurality of axial sections that are electrically isolated from each other. This makes it possible to detect short-circuits separately in the respective section. In particular sags or contacts that occur only in individual regions or sections can therefore be localized more easily and can be eliminated individually. Thus, for example, in the case of a sag of the further component it is not necessary to change the entire spacing between the rotating component and the further component; rather, it is possible to eliminate the sag, for example, by changing the sag or by locally machining the further component or the rotating component.

In order to be able to evaluate the individual axial sections separately, it is advantageous if a separate power supply and/or a separate monitoring device are/is associated with each axial section. Through this, the section that has generated a short-circuit or a contact can be detected in a very simple manner via the local short-circuits.

Advantageously, a display device for displaying the duration of all short-circuits per time unit is integrated in the textile machine. If, in an advantageous configuration, the textile machine is provided with different axial sections, it can also be advantageous to display in the display device that section in which a short-circuit has taken place. This makes it easier to localize the respective section by a machine controller or by the operator of the textile machine.

In a particularly advantageous embodiment of the textile machine, an automatic adjusting device is provided so as to be able to automatically change the spacing between the rotating component and the further component when a predetermined duration of the short-circuits per time unit is exceeded. This automatic adjusting device can be actuated by an operator of the machine or by the machine controller. Complicated manual adjustments and in particular downtime for the manual adjustments can be avoided in this manner.

BRIEF DESCRIPTION OF THE DRAWINGS

Further advantages of the invention are described in the following exemplary embodiments. In the figures.

DETAILED DESCRIPTION

Figure 1:
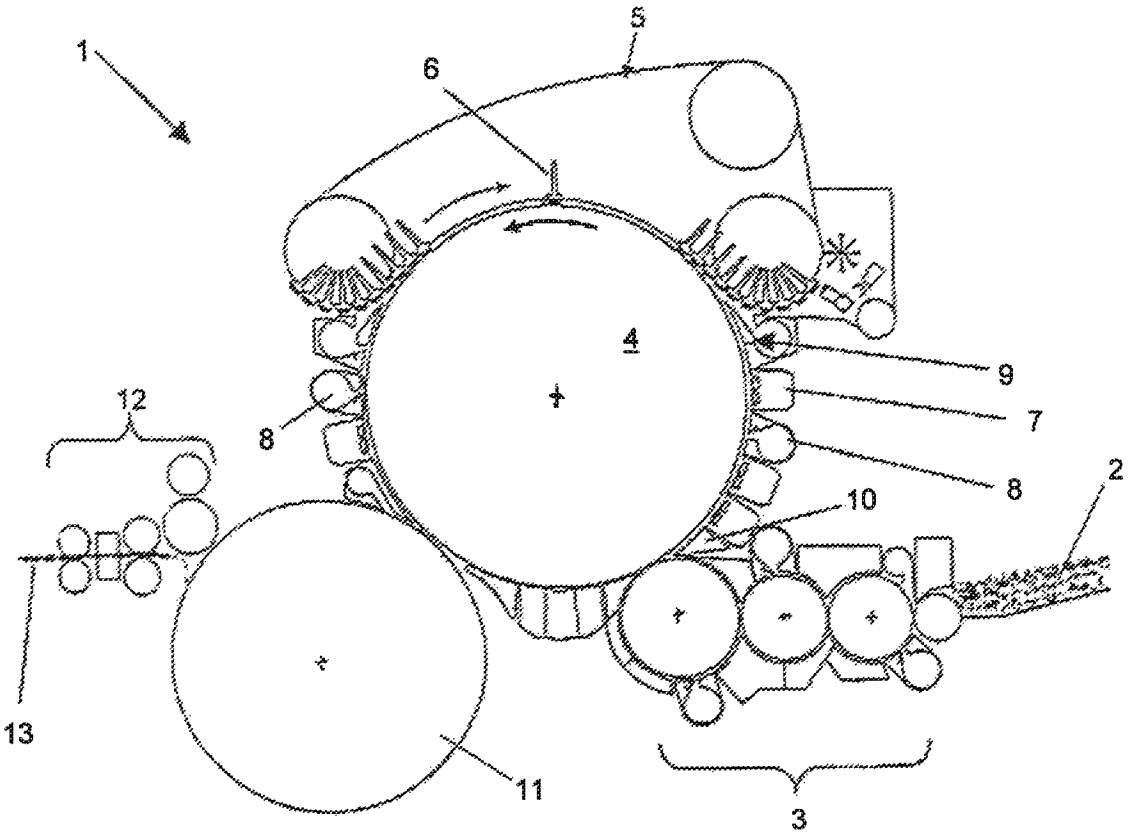
Fig. 1 Prior Art
FIG. 1 is a schematic illustration in the side view of a card according to the prior art.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows in a schematic illustration the side view of a known revolving flat card 1. Fiber flocks 2 are received as lap feed from a licker-in 3 and are transferred to a card cylinder 4. The licker-in 3 and the card cylinder 4 are each covered with clothing wires, which are not illustrated here. A non-illustrated rotational speed sensor, e.g., a pulse generator or angular position sensor or a device for detecting the revolutions or the position of the rotating component by means of pattern recognition, is associated at least to the card cylinder 4. The flocks are broken up, cleaned and parallelized on the card cylinder 4. This process is carried out by the card cylinder 4 interacting with different stationary further components 7, 8, 9, 10. Above the card cylinder 4, a revolving flat apparatus 5 is arranged which comprises individual revolving flats 6 or flat bars. The revolving flats 6 are guided counter to the rotational direction of the card drum 4 along a portion of the circumference of the card cylinder 4 by the revolving flat apparatus 4. The stationary working elements consist, for example, of carding elements 7, cutters 8 and guiding or cover elements 9, 10. On the card cylinder 4, the fibers form a fiber nonwoven that is received by a doffer roller 11 and, in a delivery section 12 consisting of different rollers, is formed in a manner known per se into a card sliver 13. This card sliver 13 is then put into a transport can by a coiler (not shown). According to the general language of the present application, the stationary working elements 7, 8, 9, 10 and the revolving flats 6 or flat bars, as well as the doffer roller 11, represent the further components which interact with the card cylinder 4, which is the rotating component.

Figure 2:
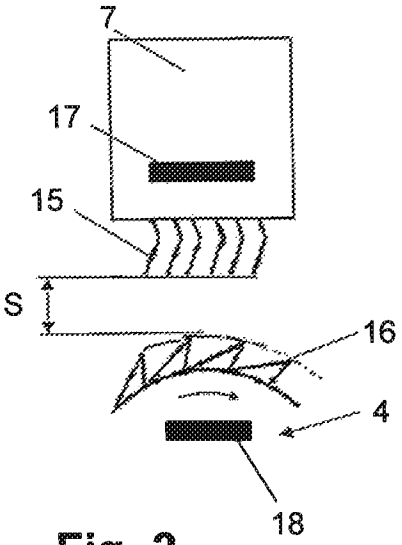
FIG. 2 is a schematic illustration of a stationary carding element with a rotating roller.

FIG. 2 schematically illustrates a stationary carding element 7 which interacts with a partially illustrated card cylinder 4. The carding element 7 has a clothing 15 which faces a cylinder clothing 16. Between the clothing 15 and the cylinder clothing 16, a gap S is provided. Normally, it is to ensure that the clothing 15 and the cylinder clothing 16 do not touch each other, but have a very tight spacing between each other, significantly tighter than the spacing illustrated here in the schematic example. In the carding element 7, a contact element 17 is arranged. Likewise, the card cylinder 4 also has a contact element 18. The contact elements 17 and 18 are each connected to the clothing 15 and the cylinder clothing 16, respectively, in a conductive manner. As soon as the clothing 15 and the cylinder clothing 16 touch each other, an electrical connection between the contact element 17 and the contact element 18 is established.

Similar to the illustration in FIG. 2, there is also a gap S between the other further components such as, for example, the cutter 8, the guiding or cover elements 9, 10, and also the moving revolving flats 5 and the doffer roller 11. It always has to be ensured that the gap S is kept small without allowing an excessively long lasting contacting between the rotating component, the card cylinder 4, and the further components.

Figure 3:
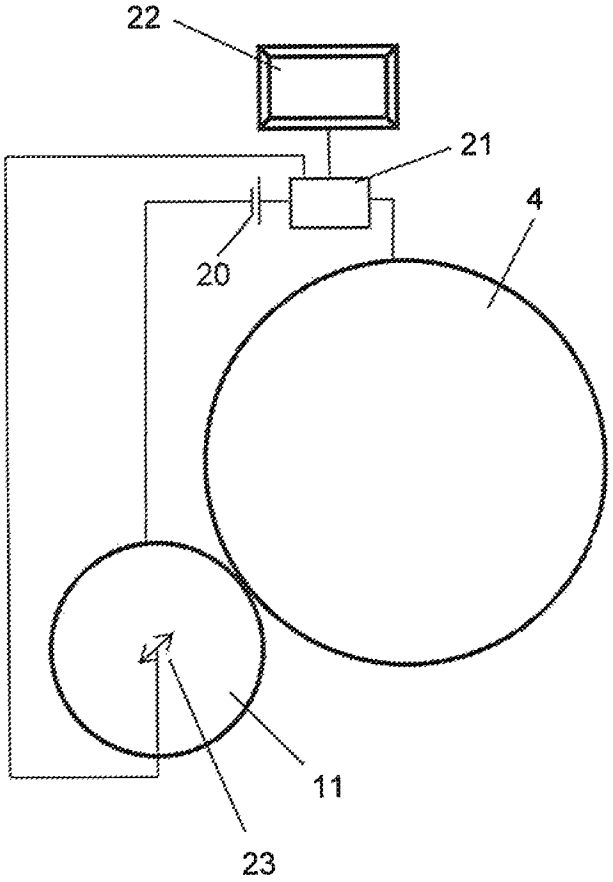
FIG. 3 is a schematic illustration for detecting a short circuit between a card cylinder and a doffer roller.

FIG. 3 schematically and exemplary illustrates for the further components, an electrical connection between the card cylinder 4 and the further component, the doffer roller 11. The card cylinder 4 and the doffer roller 11 are connected to a power source 20 via an electric line. As long as the card cylinder 4 and the doffer roller 11 do not touch each other, i.e., as long as the gap S is sufficiently large, no power transmission and therefore no short-circuit between the card cylinder 4 and the doffer roller 11 takes place. However, as soon as the two components 4 and 11 come into contact with each other because an electrically conductive material could get between the two components or because the gap S, due to heat expansion of the components 4, 11, approaches zero, a short-circuit is generated which is detected by a monitoring device 21.

According to the exemplary embodiment of the FIG. 3, a display device 22 is provided which displays the short-circuit by means of a measurement report, or by means of the duration of the short-circuit, or the duration of all short-circuits per time unit or a quotient thereof. Through the display device 22, an operator of the textile machine can take suitable measures in order to avoid damage to the textile machine, for example, to the revolving flat card 1 illustrated here.

Furthermore, in the exemplary embodiment of FIG. 3, an adjusting device 23 is illustrated, which can be optionally used for the present invention. The adjusting device 23 receives a signal, for example, from the monitoring device 21 or manually by the operator of the textile machine, by means of which signal the spacing of the doffer roller 11 from the card cylinder 4 and therefore the gap S between the two components can be changed. Through a fast and optionally automatic reaction, an excessively long lasting contacting of the two rotating components can be avoided. Of course, the device illustrated here can also be applied analogously to the other further components 6, 7, 8, 9, 10 of FIG. 1.

Figure 4:
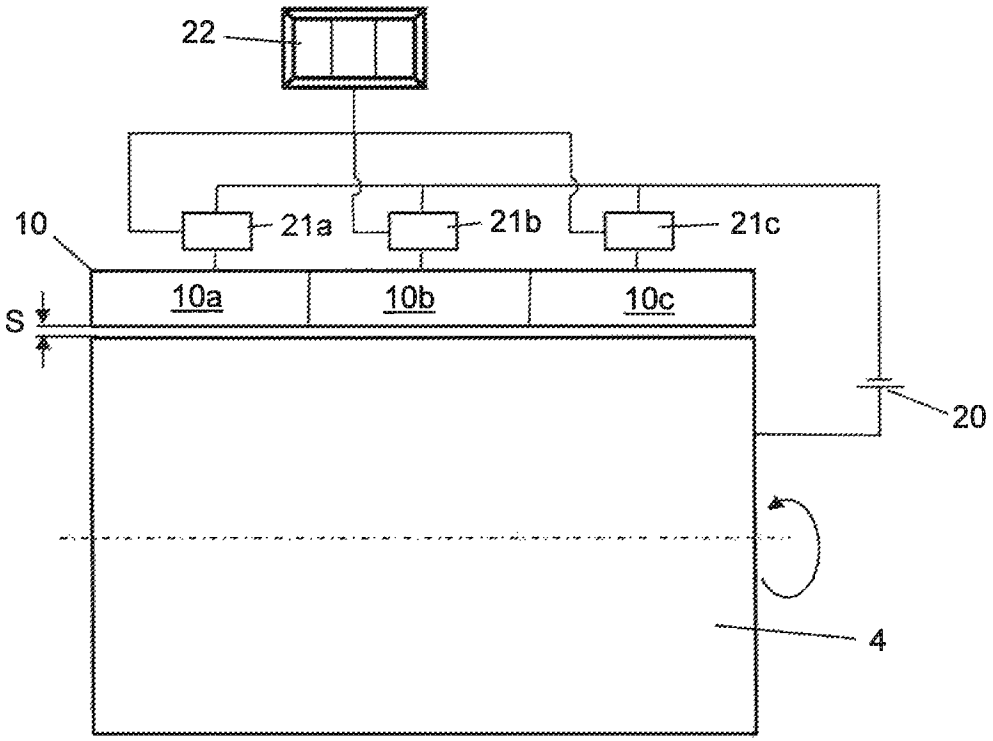
FIG. 4 is a schematic illustration of a card cylinder and a stationary component divided into sections.

FIG. 4 shows a schematic illustration of a further exemplary embodiment of the present invention. A rotating card cylinder 4, illustrated in a front view, interacts with a further component, here, for example, a cover element 10. The cover element 10 is divided in three different sections 10*a*, 10*b* and 10*c* that are electrically isolated from each other. A monitoring device 21*a*, 21*b* and 21*c* is associated with each section 10*a*, 10*b* and 10*c*. As soon as a short-circuit takes place in a section 10*a*, 10*b* or 10*c*, the monitoring device 21*a*, 21*b* or 21*c* detects this short-circuit and forwards this information to the display device 22. The display can distinguish between the respective sections 10*a*, 10*b* or 10*c* and can display in which section 10*a*, 10*b* or 10*c* contacting and therefore a short-circuit has taken place. The spacing in the respective section can be corrected in a target-oriented manner through automatic adjusting devices or through manual interventions or mechanical machining processes. Therefore, a particularly fine adjustment of the gap S between the cover element 10 and the card cylinder 4 is possible. Of course, the adjusting device illustrated here can also be applied analogously to the other further components 6, 7, 8, 9, 10 of FIG. 1.

Figure 5:
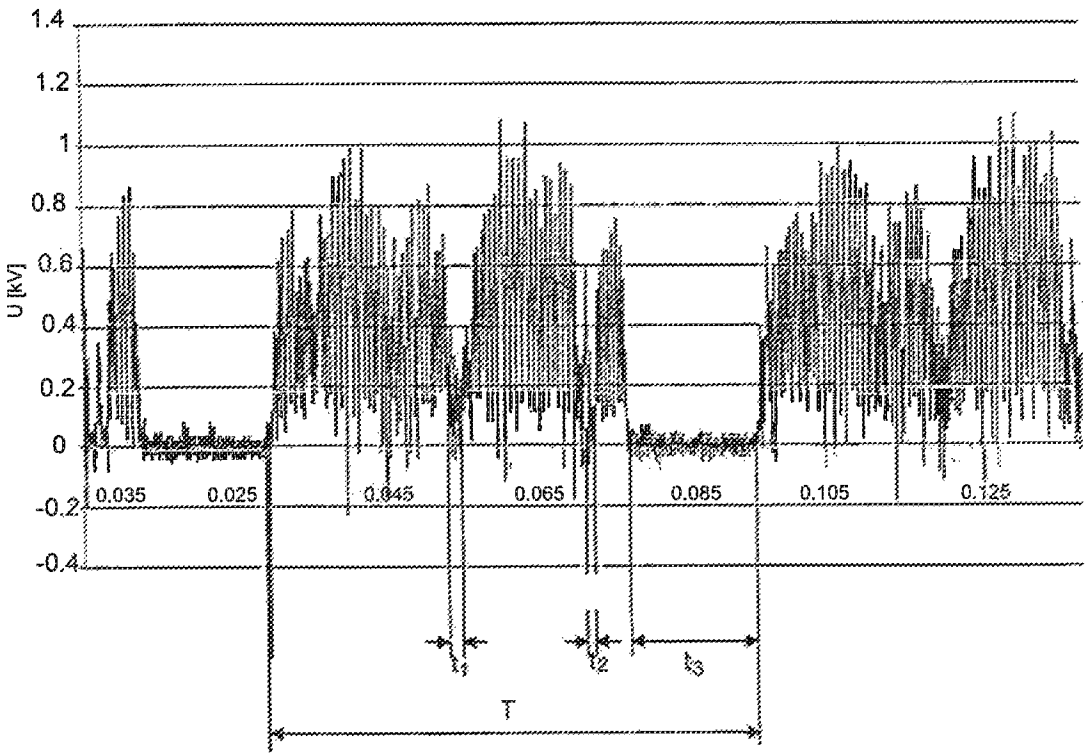
FIG. 5 is a measurement report.

FIG. 5 exemplary illustrates a measurement report of the short-circuits. The short-circuits in a time unit T are determined here with regard to their duration. Within the time unit T, the short-circuits $t_1$, $t_2$, $t_3$ take place. These durations of the short-circuits are added up, regardless of the individual number of short-circuits, and are set in relation to the total time unit T. If the duration of the entire short-circuits $t=t_1+t_2+t_3$ exceeds a certain value in relation to the entire time unit T, the machine is turned off so as to avoid damage or poor work quality, or is reset. As a quality criterion, for example, a quotient Q can be used which is calculated according to the formula $Q=(t_1+t_2+t_3)/T$. If the value of the quotient Q is too high, an adequate measure is initiated in order to increase the gap S again and hence to generate less short-circuits. The measure can also take place with a predetermined time offset, i.e., the corresponding measure is initiated only if the contact duration t inadmissibly long exceeds a predetermined extended time period. If after a short time, this total duration t of the contacts or short-circuits changes again, or if the value of the quotient Q becomes smaller again after this predetermined time and shifts into an admissible range, the measure is dispensed with.

The present invention is not limited to the illustrated exemplary embodiments. In particular, it can be applied to different textile machines and to different components of this textile machine.

Modifications and variations can be made to the embodiments illustrated or described herein without departing from the scope and spirit of the invention as set forth in the appended claims.

The invention claimed is:

1. A method for monitoring contact between a rotating component of a textile machine and another component of the textile machine, comprising:

connecting the rotating component and the other component to a common electric power source, wherein the components are not in contact and are electrically isolated during normal operations of the textile machine;

with a monitoring device, detecting short circuits that are generated by contacts between the rotating component and the other component; and wherein for multiple short circuits, the detecting step includes summing total duration time (t) for all of the detected short circuits over a defined unit of time (T) to define a total duration of short circuits per unit of time.

2. The method as in claim 1, wherein the unit of time (T) is defined as a function of the time duration of one revolution of the rotating component, the function of the time duration being one of: time duration of one revolution; a fraction of the time duration of one revolution; or a multiple of the time duration of one revolution.

3. The method as in claim 1, further comprising computing a quotient as a function of the total duration time (t) and the unit of time (T).

4. The method as in claim 3, further comprising using the quotient as a measure of quality of settings of the textile machine.

5. The method as in claim 3, further comprising displaying one or any combination of duration of individual short circuits, total duration time (t), or the quotient on a display associated with the textile machine.

6. The method as in claim 4, further comprising adjusting one or both of the components upon exceeding an acceptable value of total duration time (t) or the quotient to bring the total duration time (t) or quotient into an acceptable range.

7. The method as in claim 5, comprising increasing spacing between the rotating component and other component if the total duration time (t) or quotient exceeds the acceptable value so as to decrease the total duration time (t).

8. The method as in claim 1, further comprising dividing one or both of the rotating component and the other component into sections defined along an axis of the rotating component, wherein the sections are electrically isolated and separately monitored for short circuits.

9. A textile machine such as a carding machine, comprising:

a rotating component;

another component disposed with a spacing opposite from the rotating component;

an electric power source, the rotating component and other component connected to the electric power source but maintained electrically isolated from each other in normal operations of the textile machine;

wherein upon contact of the rotating component and the other component, a short circuit is generated;

a monitoring device configured to detect duration of multiple individual generated short circuits over a unit of time (T) and to sum the individual durations into a total duration time (t) per the unit of time (T).

10. The textile machine as in claim 9, further comprising a rotational speed sensor or angular position sensor configured with the rotating component, the monitoring device conducting pattern recognition of the detected short circuits per revolution of the rotating component to define the unit of time (T).

11. The textile machine as in claim 9, further comprising a display that displays one or any combination of duration of individual short circuits, total duration time (t), or a quotient on that is generated as a function of the total duration time (t) and the unit of time (T).

12. The textile machine as in claim 9, wherein one or both of the rotating component and the other component are defined into a plurality of electrically isolated sections defined along an axis of the rotating component, wherein the sections are separately monitored for short circuits.

13. The textile machine as in claim 12, wherein each section has an individual electric power source and monitoring device.

14. The textile machine as in claim 11, further comprising a display device that displays the total duration (t) of all short circuits of all of the sections, and total duration (t) of each section individually.

15. The textile machine as in claim 9, further comprising an automatic adjusting device configured to automatically change the spacing between the rotating component and the other component upon the total duration time (t) per unit to time (T) exceeding an acceptable value.

* * * * *